US006237719B1

(12) United States Patent
Fujii et al.

(10) Patent No.: US 6,237,719 B1
(45) Date of Patent: May 29, 2001

(54) LUBRICATING OIL DISCHARGE SYSTEM

(75) Inventors: Noriaki Fujii; Kouta Yoshiura, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/362,702

(22) Filed: Jul. 29, 1999

(30) Foreign Application Priority Data

Jul. 29, 1998 (JP) ..... 10-213638

(51) Int. Cl.[7] ..... F16N 27/00

(52) U.S. Cl. ..... 184/7.4; 384/288; 384/391; 184/6.3

(58) Field of Search ..... 184/7.4, 6.3, 6.12; 384/288, 391

(56) References Cited

U.S. PATENT DOCUMENTS 2,004,254 * 6/1935 Taub ..... 308/122
2,827,342 * 3/1958 Roach ..... 308/122
2,926,972 * 3/1960 Burrell ..... 308/121
3,958,541 * 5/1976 Lachnit ..... 123/90.34
5,988,129 * 11/1999 Prior et al. ..... 123/90.34
6,095,690 * 8/2000 Niegel et al. ..... 384/293

* cited by examiner

*Primary Examiner*—David Fenstermacher
(74) *Attorney, Agent, or Firm*—Armstrong, Westerman, Hattori, McLeland & Naughton, LLP

(57) ABSTRACT

A lubricating oil discharge port is provided that is improved so well that a quick supply of lubricating oil is not disturbed and that film lubrication is not lost when the engine is started. The lubricating oil discharge port 18*a* for allowing lubricating oil to flow out of a lubricating oil passage 18 in which an oil pressure source is provided at a lower portion thereof into a bearing bore 12 for a camshaft 10 of an engine is made to open in a top surface of a boss 19 provided so as to protrude from a bottom of a recessed well 15 acting as a lubricating oil reservoir provided in an inner circumferential surface on a lower side of the camshaft bearing bore. With this construction, the level of lubricating oil retained in the recessed well formed in the lower side of the bearing hole can be raised considerably high, and therefore even in an operating condition where the discharge pressure of an oil pump is not sufficiently increased resulting immediately the engine is started, the lubrication of the camshaft can be effected with lubricating oil retained in the lubricating oil reservoir.

5 Claims, 3 Drawing Sheets

LUBRICATING OIL DISCHARGE SYSTEM

BACKGROUND OF THE INVENTION

1. Field of the Invention

The present invention relates to a lubricating oil discharge system having a discharge port which is made to open into a bearing bore for a camshaft of an internal combustion engine.

2. Prior Art

In order to supply lubricating oil to a location needing it without any delay immediately an engine is started, it is effective to make a lubricating oil passage as short as possible, but if trying to connect an oil pump provided in the vicinity of a crankshaft to a camshaft bearing provided in a cylinder head at the shortest distance, a lubricating oil discharge port has to be opened in a lower side of the camshaft bearing.

However, if a lubricating oil discharge port is made to open in a lower side of a camshaft bearing, all lubricating oil in a bearing bore eventually drops into an oil pan when the engine is stopped, and it becomes highly probable that film lubrication is no longer effective when the engine is restarted.

SUMMARY OF THE INVENTION

Accordingly, it is an object of the present invention to provide a lubricating oil discharge system having a discharge port improved so as to solve the problem inherent in the prior art, not to disturb a quick supply of lubricating oil and to maintain film lubrication when the engine is started.

In accordance with the present invention, a lubricating oil discharge system comprises a discharge port for allowing lubricating oil to flow out of a lubricating oil passage in which an oil pressure source is provided at a lower portion thereof into a bearing bore for a camshaft of an engine. The discharge portion is made to open in a top surface of a boss provided so as to protrude from a bottom of a recessed well acting as a lubricating oil reservoir provided in an inner circumferential surface on a lower side of the camshaft bearing bore. With this construction. The level of lubricating oil retained in the recessed well formed in the lower side of the bearing bore can be raised considerably high, and therefore, even in an operating condition where the discharge pressure of an oil pump has not yet been increased sufficiently resulting immediately the engine is started, the lubrication of the camshaft bearing can be effected with lubricating oil remaining in the recessed well.

BRIEF DESCRIPTION OF THE DRAWINGS

The object and features of the present invention may be understood with reference to the following detailed description of illustrative embodiments of the present invention, taken together with the accompanying drawings in which.

DESCRIPTION OF THE PREFERRED EMBODIMENTS

Figure 1:
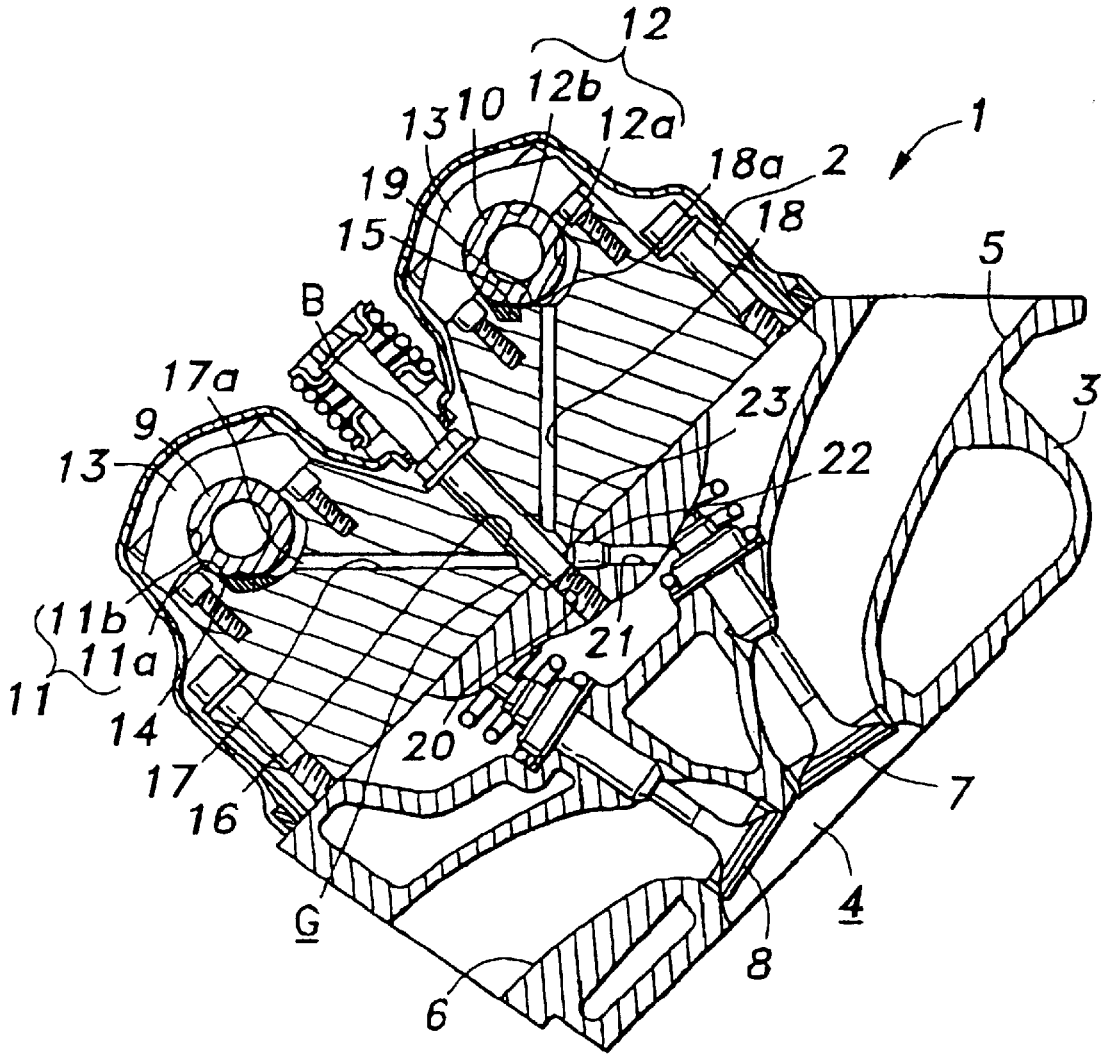
FIG. 1 is a sectional view of a cylinder head of an engine to which the present invention is applied.

FIG. 1 shows a cylinder head portion of an engine to which the present invention is applied. This cylinder head 1 comprises two members that are integrally connected together with a plurality of bolts, an upper head 2 and a lower head 3. Provided on the lower head 3 are a combustion chamber 4, which is defined in a joint between the lower head 3 and a cylinder block, not shown, an intake passage 5 and an exhaust passage 6 both communicating with the combustion chamber 4, an intake valve 7 for opening and/or closing the communication between the intake passage 5 and the combustion chamber 4, and an exhaust valve 8 for opening and/or closing the communication between the exhaust passage 6 and the combustion chamber 4. On the other hand, two camshafts 9, 10 are supported on the upper head 2 for driving the intake valve 7 and the exhaust valve 8, respectively.

Figure 2:
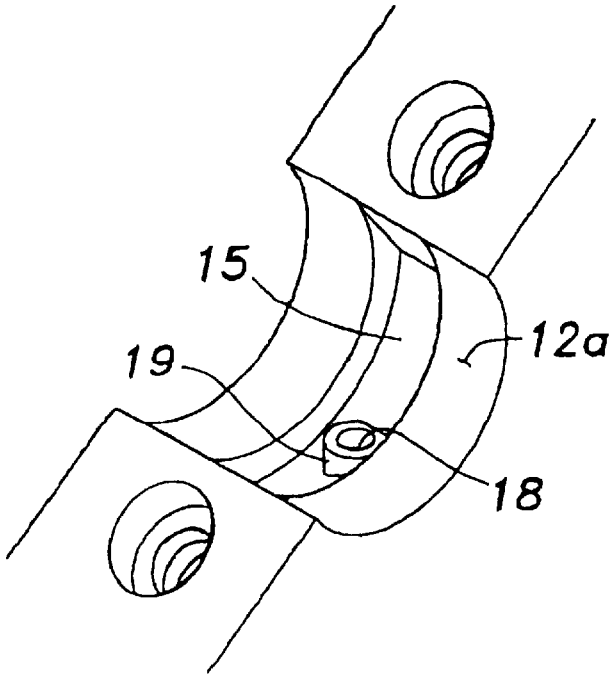
FIG. 2 is an enlarged perspective view of a bearing bore for a camshaft.

Bearing bores 11, 12 for the two camshafts 9, 10 each comprise semicircular portions 11*a*, 12*a* recessed in an upper surface of the upper head 2 and semicircular portions 11*b*, 12*b* of bearing caps 13 bolted down to the upper surface of the upper head 2. As shown in FIG. 2, a recessed well 15 acting as a lubricating oil reservoir is recessed in an axially intermediate portion of the semicircular portion 12*a* on the upper head 2 side.

A pair of lubricating oil passages 17, 18 are provided so as to branch from an insertion hole 16 for a bolt B among those used to connect the upper head 2 to the lower head 3 which is provided on a line parallel with the axis of a crankshaft of the engine. This engine is installed such that it is inclined along the axis of the cylinder substantially at an angle of 45 degrees relative to a vertical line, and when installed in a vehicle, the first lubricating oil passage 17 is constructed so as to extend on a horizontal plane, while the second lubricating oil passage 18 to extend on a vertical plane. A discharge port 17*a* of the first lubricating oil passage 17 is constructed to open in a side of a recessed well 14 of a bearing bore 11 that is to be located on a lower side of the engine when it is installed in the vehicle, while a discharge port 18*a* of the second lubricating oil passage 18 to open in a top surface of a boss 19 provided on a bottom of a recessed well 15, so as to protrude therefrom, of a bearing bore 12 which is to be located on an upper side of the engine when it is installed in the vehicle. Thus, it becomes possible to retain in the recessed well 15 an amount of lubricating oil sufficient to form a lubrication film immediately the engine is started by constructing the discharge port 18*a* of the lubricating oil passage 18 such that it opens at as high a position as possible.

Note that the boss 19 is preferably disposed at the lowest portion of the recessed well 15.

Figure 3:
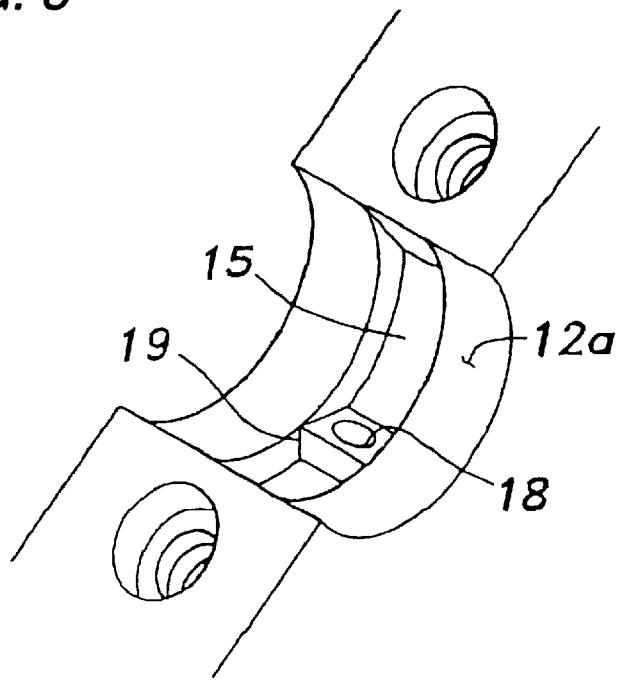
FIG. 3 is an enlarged perspective view of a modified embodiment of the camshaft bearing bore.

As shown in FIG. 3, even if the recessed well 15 is formed in the bearing bore 12, the reduction in rigidity of the bearing bore 12 can be restrained if the boss 19 is formed such that it connects together inner surfaces of side walls of the recessed well 15, and therefore, the smoothness in rotation of the camshaft is protected against deterioration that would be caused otherwise, this enabling to eliminate a risk of the operation noise being increased.

A bolt insertion hole 20 is made to open in an upper surface of the lower head 3 or the joint between the lower head 3 and the upper head 2, the bolt insertion hole 20 being formed in the lower head 3 in such a manner as to align with the bolt insertion hole 16 formed in the upper head 2. A third lubricating oil passage 21 is then formed to extend from an aperture of this bolt insertion hole 20 at an angle of 45 degrees relative to the upper surface of the lower head 3. This third lubricating oil passage 21 is connected with a lubricating oil passage formed in a cylinder block, not shown, in such a manner that lubricating oil discharged from an oil pump as an oil pressure source flows thereinto. Then, lubricating oil flowing into the third lubricating oil passage 21 is designed to be fed out into the first and second lubricating oil passages 17, 18 via a gap G between an inner circumferential surface of the bolt insertion hole 16 and an outer circumferential surface of the bolt B.

An orifice member 22 is press fitted in an opening portion of the third lubricating oil passage 21, the orifice member 22 being basically formed into a cylindrical shape. A conical surface 23 of the orifice member 22 is formed at an end of the third lubricating oil passage 21 on the open end side thereof, and this conical surface 23 is constructed so as to be brought into abutment with a superficial position on the upper head 2 where it joins with lower head 3, once the upper and lower heads 2, 3 are joined with each other, whereby the orifice member 22 is brought into a superficial contact with the upper head 2 to be thereby positioned in place and prevented from being disengaged therefrom.

Figure 4:
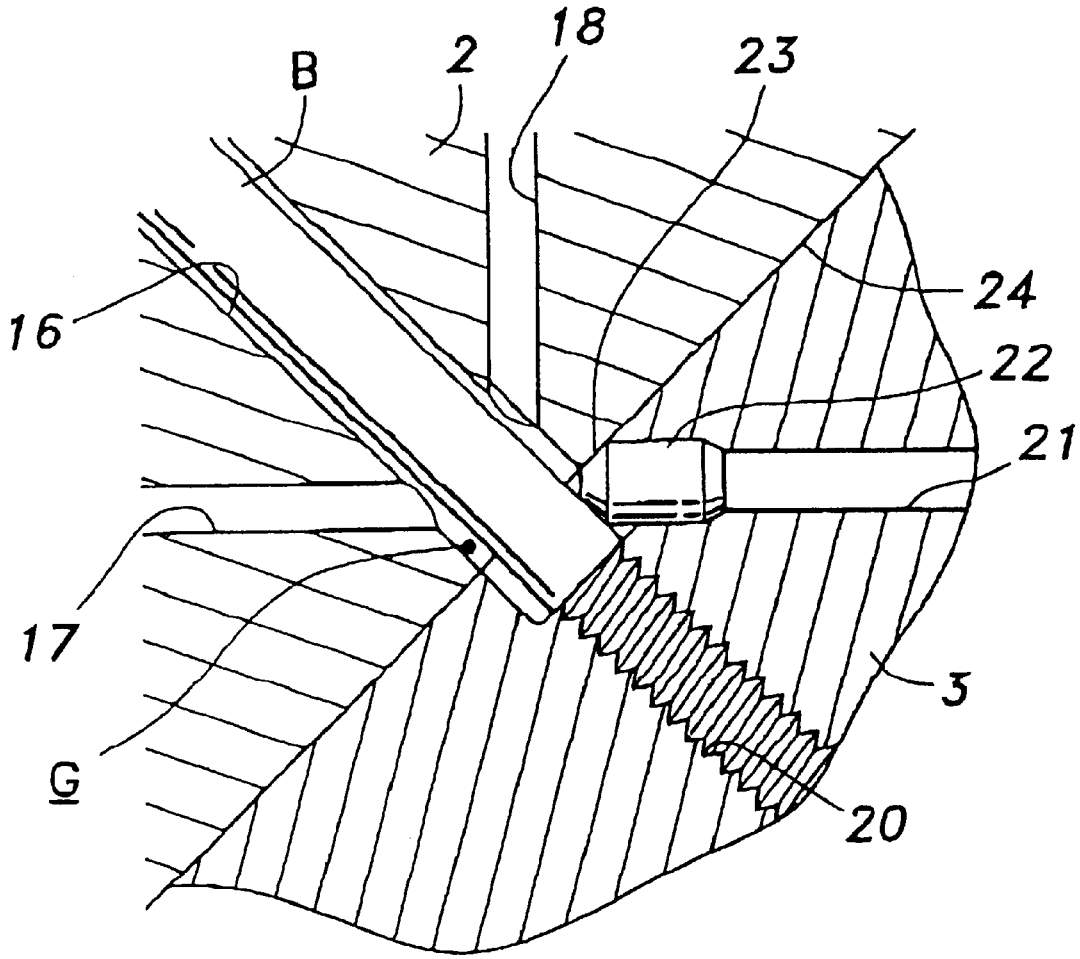
FIG. 4 is an enlarged perspective view of a portion around an orifice member in an another modified embodiment.

Although in the above-mentioned embodiment, the orifice member 22 is positioned in place by bringing the conical surface 23 into abutment with only a superficial position on the upper head 2 where it joins with lower head 3 when the upper and lower heads 2, 3 are joined with each other, it is possible to modify it in such a manner that the orifice member 22 is positioned in place by bringing the conical surface 23 into abutment with only the outer circumferential surface of the bolt B. Further, a shown in FIG. 4 it is also possible to modify it in such a manner that the orifice member 22 is positioned in place by bringing the conical surface 23 into abutment with both of the outer circumferential surface of the bolt B and the superficial position on the upper head 2.

The present invention is based on Japanese Patent Application No. Hei. 10-213638, which is incorporated herein by reference.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

Thus, in accordance with the present invention, as described above, since the discharge port for lubricating oil remaining in the recessed well formed in the lower side of the bearing bore is constructed so as to open at as high a position as possible, lubricating oil can be retained in the bearing bore when the engine is not in operation even in a construction in which the lubricating oil discharge port is made to open upwardly in the bearing bore. Thus, even in an operating condition where the oil pump discharge pressure is not sufficiently increased immediately the engine is started, the lubrication of the camshaft can be effected with lubricating oil remaining in the recessed well. Consequently, the present invention is markedly effective in evading a loss of film lubrication immediately the engine is started without disturbing a quick supply of lubricating oil.

What is claimed is:

1. A lubricating oil discharge system, comprising:

a cylinder head;

a bearing bore for a camshaft of an engine, said bearing bore being provided on an upper surface of said cylinder head;

a lubricating oil discharge port for allowing lubricating oil to flow out of a lubricating oil passage into said bearing bore;

a recessed well provided on an inner surface of a lower side of said bearing bore for reserving a lubricating oil; and said lubricating oil discharge port extending through said cylinder head and protruding from a bottom of said recessed well to form a boss, wherein said lubricating oil discharge port is made to open in a top surface of said boss.

2. The lubricating oil discharge system according to claim 1, wherein said boss is formed between side walls defining said recessed well so as to connect said side walls.

3. The lubricating oil discharge system according to claim 1, wherein said cylinder head comprises an upper head and a lower head connected therewith, and said bearing bore is formed on an upper surface of said upper head.

4. The lubricating oil discharge system according to claim 3, further comprising:

an orifice member disposed in an additional lubricating oil passage which is communicated with said lubricating oil passage and is formed in said lower head, wherein said orifice member has an conical surface at its upper end such that said orifice member is positioned in place by bringing said conical surface into abutment with an interface between said upper head and said lower head, when said upper and lower heads are joined with each other.

5. The lubricating oil discharge system according to claim 1, wherein said boss is disposed at the lowest portion of the recessed well.

* * * * *